United States Patent [19]

Proellochs

[11] Patent Number: 4,645,102

[45] Date of Patent: Feb. 24, 1987

[54] ASSEMBLY COMPRISING A FLAT HOUSING FIXED ON A TEXTILE OR A THIN SYNTHETIC OR NATURAL MATERIAL

[75] Inventor: François Proellochs, Forel-Lavaux, Switzerland

[73] Assignee: Samel, S.A., Switzerland

[21] Appl. No.: 727,008

[22] Filed: Apr. 25, 1985

[30] Foreign Application Priority Data

Apr. 15, 1985 [CH] Switzerland ..... 1594/85

[51] Int. Cl.[4] ..... A44C 5/00

[52] U.S. Cl. ..... 224/178; 224/164

[58] Field of Search ..... 224/175, 178, 164–179; 24/265 WS; 248/27.1; 63/3–7; 29/177, 179

[56] References Cited

U.S. PATENT DOCUMENTS

| | | | |
|---|---|---|---|
| 499,891 | 6/1893 | Schlesicky | 224/164 |
| 4,060,185 | 11/1977 | Kuroda | 224/176 |

FOREIGN PATENT DOCUMENTS

| | | | |
|---|---|---|---|
| 44669 | 4/1977 | Japan | 224/164 |
| 68280 | 6/1978 | Japan | 224/164 |
| 579302 | 8/1976 | Switzerland | 224/164 |

*Primary Examiner*—Henry K. Artis
*Assistant Examiner*—Robert M. Petrik
*Attorney, Agent, or Firm*—Ostrolenk, Faber, Gerb & Soffen

[57] ABSTRACT

This invention comprises an assembly between a thin substrate and a housing removably attached thereto.

The textile or the other thin material constituting the substrate comprises a ring (6) set to the periphery of a circular aperture cut beforehand into the substrate at a predetermined location, the housing having a circular bottom introduced in the ring, and the housing and the ring being provided with fixing elements which cooperate to achieve a removable fixation of the housing to the substrate.

19 Claims, 4 Drawing Figures

ASSEMBLY COMPRISING A FLAT HOUSING FIXED ON A TEXTILE OR A THIN SYNTHETIC OR NATURAL MATERIAL

BACKGROUND OF THE INVENTION

This invention belongs to the technical field of assembling different materials. More particularly, the invention relates to an assembly comprising a flat housing and a thin sheet or ribbon like material such as a textile, or another synthetic or natural material, said flat housing being removably fixed to said material. Still more particularly, the present invention is concerned with a flat case containing a clock movement, assembled to an extensible textile ribbon, such constituting a kind of wrist watch having a removable clock.

A research effected by the applicant has shown a prior art disclosing a clock within a watchcase, the latter being unremovably riveted to a bracelet-like unextensible ribbon adapted to be put around the wrist with the aid of a velcro fixing. The watch is thus integrated into a textile ribbon in an irremovable manner.

SUMMARY OF THE INVENTION

It is a first and major object of this invention to develop an assembly or composite object comprising a flat housing or case, and a textile material, allowing to removably fixing or joining the housing to the textile material.

Another object of this invention is to provide an assembly of the just depicted kind which can be realized with any material of the housing or case, on one hand, and the thin substrate such as a textile material, but also other thin materials, of natural or synthetic origin, on the other hand.

It is also an object of this invention to provide a solid but nevertheless removable assembly of the described kind where the housing is a watchcase containing a clock, thus allowing an easy removal of the watch from a textile substrate, for example before laundering.

It is a further object of the present invention to provide a method for the manufacture of the assembly mentioned above wherein new and useful steps are combined to obtain a solid assembly of a rigid housing body to a rather floppy material such as a textile substrate which generally has not a great dimension stability.

Additional objects will become apparent from the following description of the present invention, its embodiments, and the appended claims.

In one of its embodiments, the present invention is an assembly comprising a flat housing fixed on a textile substrate or on a thin material of synthetic or natural origin where said textile substrate or this material, respectively, has a support ring set on the periphery of an aperture fitted beforehand in the substrate at a predetermined location, said housing having a circular bottom inserted into said ring and having substantially the same thickness as the latter, said housing and said ring comprising fixing means cooperating to ensure a removable fixation of said housing to said substrate.

The term "substrate" as used herein comprises textile materials such as ribbons, bracelets, headbands, garments such as shirts or trousers, stockings, thus generally outerwear articles; furthermore foils and sheets of limited thickness made from natural materials, such as leather, and synthetic materials such as plastics, comprising also manufactured articles such as braids.

In a preferred embodiment where the housing is a case adapted to contain a clock movement, the said fixing means between said housing and said ring comprise a circular edge provided on the inner periphery of said ring, and at least two flexible tongues extending in parallel and adjacent relationship to the circular bottom of said housing, said tongues being provided, at their outer surface, with projections to be lodged under said circular edge of said ring.

A space may be provided between the circular bottom of the housing and the tongues, said space being destined to receive a blocking ring adapted to push said tongues against the edge of the ring which is set to the substrate.

Spacer ribs can be provided on the periphery of the circular bottom in order to fill in the space between the circular bottom and the ring, at either side of said tongues.

In another preferred embodiment, the fixing means between the housing and the support ring comprise a thread provided on the outer periphery of the circular housing bottom, cooperating with a corresponding thread on the interior of a blocking ring to be inserted or screwed between the circular housing bottom and the ring set to said substrate.

The said support ring may be made of metal such as aluminium. It may, however, also be made from plastics and can be metalized on its surfaces.

As it has already been mentioned above, the housing is, in a preferred embodiment, a case adapted to receive a clock movement. However, it may also be destined, alternatively, to contain a compass, or it may simply be hollow and fitted with a tight cover to receive and contain tiny objects such as pearls, candies, etc.

The housing may be made of plastics.

The substrate may be a textile object such as an elastic band for a wrist or a head-band. The assembly can be produced on any garment, for example near the belt of trousers, on the belt itself, on the pocket or the cuffs of shirts, etc.

Still another aspect of the present invention is a method for the manufacture of the assembly, already described in general terms above, comprising applying a flexible counterpiece to said substrate, the diameter of said counterpiece - which may be of circular shape-being slightly superior to the diameter of said ring to be set afterwards; perforating or punching the composite comprising the substrate and the counterpiece to the diameter of said ring, applying a heat treatment to the edges of the punched hole, and introducing and setting said ring.

A variant of this method comprising making a circular hole into the substrate, having the diameter of said support ring, and introducing and heat setting said ring. In this variant, the ring will generally be of a thermoplastic material, and it can be heat set or fixed and formed by injection molding.

BRIEF DESCRIPTION OF THE DRAWING

The invention will be better understood when consideration is given to the following detailed description of special embodiments thereof. Such description makes reference to the annexed drawing wherein.

DETAILED DESCRIPTION OF PREFERRED EMBODIMENTS

Figure 1:
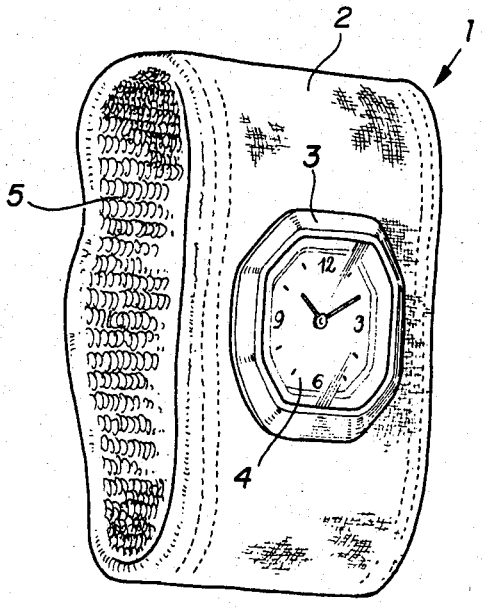
FIG. 1 represents an assembly of an elastic wristband and a watchcase containing a clock, the assembly being achieved with the aid of removable fixing means between a ring attached to said wristband, and the watchcase.
Figure 2:
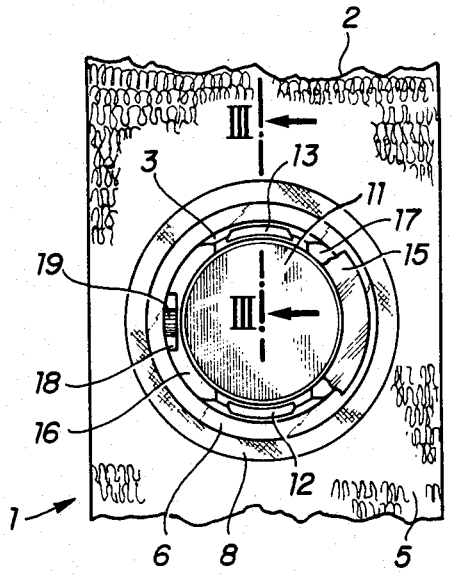
FIG. 2 is a view from below of the wristband of FIG. 1, at the location of the fixation of the watchcase.
Figure 3:
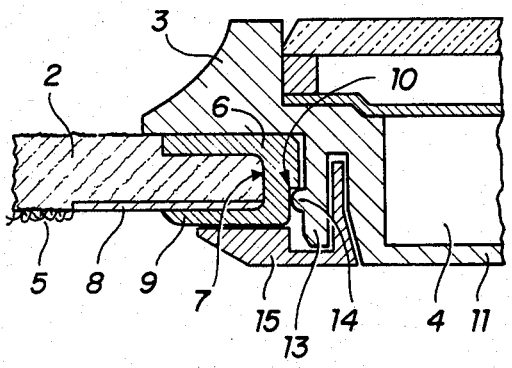
FIG. 3 represents a vertical section in the line III—III of FIG. 2.

The embodiment of assembly 1 shown in FIG. 1, 2 and 3 comprises a wristband 2 having fixed thereon a housing or watchcase 3 containing the movement of the clock 4 with clockface and hands. The wristband 2 has been made from a cotton fabric containing elastomer weft yarns. On its inner face 5, the wristband has curled weft yarns so that the surface of the wristband which will be in contact with the wrist of the user has the properties of a foam like fabric. The wristband 2 has been executed as already mentioned, from cotton yarn, and the elastomere weft yarn has been selected such as to guarantee, together with the construction of the fabric, the respiration of the skin and to avoid any allergy of the user.

A ring 6 is fixed on the wristband 2, set on the periphery of an aperture 7 punched beforehand in the said wristband, the aperture having a diameter equal to that of the ring 6. The ring 6 is set on the periphery of the aperture 7 after the application of a counterpiece 8 against the inner surface of the wristband, the peripheral region of the edge 7 having been heat treated beforehand, so as to heat set the elastomer fibers of said wristband after the punching of the aperture. The counterpiece 8 may be cemented against the lower surface 5 of the wristband 2 or may be applied by a heat treatment. In this case, the counterpiece will be coated with an adhesive composition, or it will be made from a material sticking to the surface 5 when a heat treatment is applied. After the introduction of the ring 6 into the aperture whose peripheral region has been heat treated as already mentioned, the inferior part 9 of the ring 6 is bent back against the inferior surface 5 of the band 2, as shown in FIG. 3, and this finishes the setting operation. As shown in FIG. 3, the ring 6 has a circular edge 10 which serves as an anchoring seat for the housing 3; this will be explained below. The housing 3 (FIG. 2 and 3) has a circular bottom 11 and two tongues 12 and 13 extending in parallel and adjacent relationship at either side of the circular bottom 11. The tongues 12 and 13 are provided at their outer faces with a projection 14 destined to come into contact with the edge 10 of the ring 6 so as to keep the housing in place within the ring 6 (FIG. 3). An annular space is provided between the tongues 12 and 13 and the circular bottom of the housing 3, said annular space being destined to receive a blocking ring 15 adapted to push the tongues 12 and 13 against the ring 6. The ring 15 is simply pushed into the free space between the tongues 12 and 13 and the edge of the circular bottom 11 of the housing, and it is maintained in place by friction. When it is desired to remove the housing 3 from the ring 6, the blocking ring 15 will be removed, and the housing 3 can be separated from the textile band 2 by simple pressure of the thumb applied onto the circular bottom 11 of the housing. The circular bottom 11 of the housing is further fitted with spacer ribs 16 and 17 placed circumferentially between the tongues 12 and 13. These spacer ribs 16 and 17 are destined to avoid any lateral displacement of the housing relative to the ring 6. The height of the spacer ribs 16 and 17 amounts to about the half of the height of the tongues 12 and 13, so that the blocking ring 15 can be inserted without touching the spacer ribs. The spacer rib 16 also has a recess 18 allowing the insertion of the winder 19 of the clock 3 (see FIG. 2).

Figure 4:
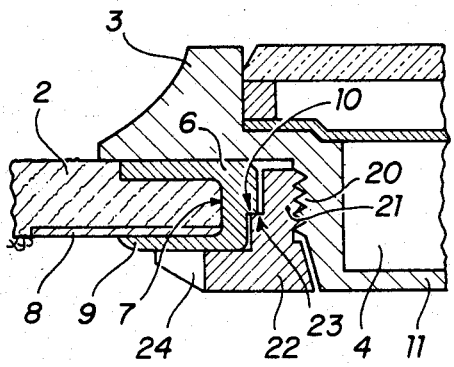
FIG. 4 is a variant of the section of FIG. 3 wherein the assembly is executed by means of a blocking ring threaded on the housing.

In the variant shown in FIG. 4, the housing 11 has a thread 20 on its circumference cooperating with a corresponding thread 21 provided on a screw ring 22. Except for the thread 20 which replaces the tongues 12 and 13 as well as the spacer ribs 17 and 18 in the embodiment shown in FIGS. 1 to 3, the housing 3 of the variant of FIG. 4 has exactly the same configuration as that of the preceding embodiment. The ring 6 set on the wristband 2 and the counterpiece 8 have also the same configuration as the ring 6 of the embodiment shown in FIGS. 1 to 3 together with the circular edge 10. The screw ring 22 is thus screwed onto the circular bottom 11 of the housing 3 after its introduction into the ring 6. During this screwing operation, the screw ring 22 which has a circular edge 23 corresponding to the edge 10 of the ring 6, comes in contact with the latter and allows to block the housing 3 against the said ring 6. The screw ring 22 further has on its outer circumference points 24 allowing the execution of the screwing operation and the blocking of the assembly. The thickness of the upper part of the ring 22 fills the space between the ring 6 and the circular bottom 11 of the housing 3, as it is shown in FIG. 4, and thus avoids any lateral displacement of said housing 3 relative to the ring 6. If it is intended to separate the housing 3 from the textile band 2, the screw ring 22 is to be threaded off and the housing 3 can be removed from above. In the variant shown in FIG. 4, the housing is equally provided with a clock movement 4 with its clockface, its hands and its covering glass.

The housing 3 which has now been described with reference to the embodiment shown in FIGS. 1 to 3 and also in its variant of FIG. 4, is generally made from plastic material as well as the blocking ring 15 or the screw ring 22. The ring 6 which is set on the fabric 2 is made, in the embodiments of FIGS. 1 to 3 and its variant in FIG. 4 of a metal, preferably of aluminium. The use of a metal, especially of aluminium, allows to obtain a solid and long lasting blocking of the ring to the edges of the textile material 2 after the latter has been heat treated in order to set the elastic fibers on the periphery of the aperture where the ring 6 will be set.

As a variant, ring 6 may also be made from a thermoplastic material. In this case, it will be heat set after the treatment of the textile material, or it may be injection molded in an appropriate extrusion die.

The setting operation is performed in the following manner:

At the predetermined location of the textile material where the ring should be lodged, a counterpiece is fixed to the textile material, for example by cementing or by heat treatment. This counterpiece is placed on the inferior, curled surface of the textile material 2. The cutting or punching operation is now executed which consists in making an aperture into the textile material whose diameter corresponds to that of the ring 6. This cutting operation must be imperatively followed by a heat treatment or a cementing capable of setting the textile fibers on the periphery of the aperture in order to avoid fraying of the textile. The ring 6 is now introduced into the aperture, and the setting thereof is carried out. As a variant, and when a ring 6 of a plastic material is used, the latter may be injection molded by means of an appropriate extrusion die. In this case, the heat treatment may be executed simultaneously with the injection of the ring, and the counterpiece may be foregone.

The assembly which has now been described in all details is achieved between a housing containing a clock movement with its clockface, its hands and its covering glass, on one hand, and a wristband described in detail in the foregoing, on the other hand. The man skilled in the art will be aware of the fact that such an assembly may be executed with any textile material whatsoever or with any thin material, be it synthetic or natural. The assembly has the advantage that the watchcase may be removed from the textile material whereon it is fixed, for example before laundering the textile article. After laundering, the housing 3 will be replaced on the textile article. The housing 3 may also be fixed on a head-band or any other garment or textile article, for example on the pocket or the cuff of a shirt, onto the pocket of trousers, etc. As a variant, the housing 3 containing a clock movement with its clockface, its hands, and its glass, can be placed on any thin synthetic or natural material such as boxes, portfolios, wallets, purses, etc., be it of synthetic materials or of natural ones, such as leather. The advantage brought about by the assembly of this invention is the fact that the housing can be removed and reinserted according to the wishes of the user. The housing 3 is adapted to receive a clockwork of good quality, for example a quartz clockwork with analogue display as represented in FIG. 1. However, the man skilled in the art will realize that the housing 3 can also be made of metals, such as steel, silver, gold, platinum, etc.

On the other hand, the housing 3 may be adapted to receive other things than clockworks, for example compasses, and it can also be provided with a tight cover enabling it to receive tiny personal objects.

The assembly of this invention has the further advantage to constitute a removable but reliable fixation of a housing on a textile piece, the housing and the textile material or article having cooperating fixing means for providing a removable fixation. On the other hand, the assembly does not present an additional thickness, the thickness of the circular bottom of the housing being substantially equal to the thickness of the textile substrate or the thin material.

It should be noted that this invention is by no means limited by the foregoing description of preferred embodiments thereof but rather is defined by the claims.

1. An assembly wherein a flat housing is fixed on a third substrate comprising material such as textile materials or thin synthetic or natural non-textile materials, said assembly comprising:

a support ring fixed by setting on a counterpiece adhered to a first surface of said substrate along the periphery of an aperture in said substrate at a predetermined location thereof, said support ring having first and second projections for grippingly engaging, respectively, said counterpiece, and a second surface of said substrate opposite said first surface and along the periphery of said aperture, said housing having a circular bottom introduced into said support ring, said circular bottom and said support ring having substantially the same thickness, and said housing and said support ring being provided with cooperating fixing means for removably fixing the housing to said substrate.

2. The assembly of claim 1 wherein said fixing means comprise a circular edge on the inner periphery of said support ring and at least two flexible tongues extending in parallel and adjacent relationship to said circular bottom of the housing, said tongues having a projection on their outer surfaces adapted for being lodged under said circular edge of the support ring.

3. The assembly of claim 2, further comprising a space between the circular bottom of the housing and said tongues, said space being adapted for receiving a blocking ring pushing said tongues against said circular edge of said support ring.

4. The assembly of claim 3, further comprising spacer ribs provided on the periphery of said circular bottom, said ribs filling in the space between said circular bottom and said support ring, on either side of said tongues.

5. The assembly of claim 1 wherein said fixing means comprise a thread provided on the periphery of the circular bottom of said housing, cooperating with a corresponding thread provided at the interior of a blocking ring adapted for insertion in the space between said circular bottom and said support ring.

6. The assembly of claim 1 wherein said support ring is made of a metal.

7. The assembly of claim 1 wherein said support ring is made of a plastics material.

8. The assembly of claim 1, further comprising a clockwork which is contained in said housing.

9. The assembly of claim 1, further comprising a compass lodged within said housing.

10. The assembly according to claim 1 wherein said housing is fitted with a tight cover adapted for being opened.

11. The assembly of claim 1 wherein said housing is made of a plastics material.

12. The assembly of claim 1 wherein said substrate is a textile material in the form of an elastic wristband.

13. The assembly of claim 1, executed on an outerwear garment.

14. A method for the manufacture of an assembly of a fixed housing on a substrate according to any one of the preceding comprising the following steps:

(1) selecting a location on a substrate selected from the group formed by textile materials and thin synthetic or natural non-textile materials, (2) applying a flexible counterpiece to said substrate at said selected location, the diameter of said counterpiece being slightly superior to the diameter of a supporting ring for supporting said housing, (3) making an aperture having the diameter of said supporting ring, at the centre of said location, comprising said substrate and said counterpiece, (4) applying a heat treatment to the edges of said aperture, and (5) introducing and setting said supporting ring in said aperture.

15. The method of claim 14 wherein said support ring is heat set in said aperture.

16. The method of claim 14 wherein said support ring is injection molded into said aperture.

17. The assembly of claim 6 wherein said metal is aluminium.

18. The assembly of claim 1 wherein said counterpiece is adhered to said substrate by an adhesive.

19. The assembly of claim 1 wherein said counterpiece is adhered to said substrate by heat treatment.

* * * * *